United States Patent [19]

Narusawa et al.

[11] Patent Number: 4,522,909

[45] Date of Patent: Jun. 11, 1985

[54] PROCESS FOR PREPARING ELECTROSTATIC DEVELOPER

[75] Inventors: Toshiaki Narusawa, Sagamihara; Seiji Okada, Kawasaki; Kiyohide Muramatsu, Tokyo; Teruo Yagishita, Yokohama; Hirofumi Okuyama, Sagamihara, all of Japan

[73] Assignee: Fujitsu Limited, Kawasaki, Japan

[21] Appl. No.: 501,800

[22] Filed: Jun. 7, 1983

Related U.S. Application Data

[63] Continuation-in-part of Ser. No. 232,805, Feb. 9, 1981, abandoned, which is a continuation of Ser. No. 62,311, Jul. 20, 1979, abandoned.

[30] Foreign Application Priority Data

Aug. 1, 1978 [JP] Japan ..... 53-93110
Mar. 26, 1979 [JP] Japan ..... 54-34221

[51] Int. Cl.[3] ..... G03G 11/00; G03G 9/10
[52] U.S. Cl. ..... 430/137; 430/904
[58] Field of Search ..... 430/137

[56] References Cited

U.S. PATENT DOCUMENTS

| | | | |
|---|---|---|---|
| 2,892,794 | 6/1959 | Insalaco | 430/106 |
| 3,338,991 | 8/1967 | Insalaco | 430/137 |
| 3,526,533 | 9/1970 | Jacknow et al. | 428/403 |
| 3,922,382 | 11/1975 | Kukla et al. | 430/137 |

*Primary Examiner*—John D. Welsh
*Attorney, Agent, or Firm*—Staas & Halsey

[57] ABSTRACT

A process for preparing a developer for electrostatic images comprising: (1) immersing carrier beads in an organic solution of a resin material comprising a 1,2-butadiene or cyclized cis-1,4-butadiene homopolymer, or a mixture of at least one of the homopolymers and a styrene butadiene copolymer; evaporating the organic solvent of the solution, drying the immersed beads, and curing the resin material by a rotary drying method, to form a resin coating on the carrier beads; (2) blending toner materials at a temperature sufficient to form a toner mass, the toner materials comprising: (a) a binder resin, (b) a colorant, and (c) a charge controlling agent; and (3) pulverizing the blended toner mass to form toner particles and mixing the obtained toner particles with the coated carrier in a predetermined ratio of the total surface area of the carrier to the total projection area of the toner particles.

41 Claims, 12 Drawing Figures

1,2-PB
CYCLIZED CIS-1,4-PB
CIS-1,4-PB
TRANS-1,4-PB
RATIO OF TONER CHARGE TO MASS(μC/g)
20
16
12
8
4
0
0
2.0
4.0
6.0
8.0
10.0
12.0
PRINTED SHEETS (×10⁴)

PROCESS FOR PREPARING ELECTROSTATIC DEVELOPER

The present application is a continuation-in-part of U.S. Ser. No. 232,805 filed Feb. 9, 1981, now abandoned which itself is a continuation of the now-abandoned U.S. Ser. No. 62,311 filed July 20, 1979.

BACKGROUND OF THE INVENTION

The present invention relates to a process for preparing a developer for electrostatic images, particularly for use in an electrostatic high speed printer.

A known developer for electrostatic images comprises a mixture of smaller resinous toner particles and larger carrier beads made of iron or glass. The toner particles are held on the surface of the carrier beads by electrostatic force, which develops from the triboelectric charging of the toner particles and the carrier in opposite polarities due to contact therebetween. When the developer is moved into contact with the latent electrostatic images formed on a photoreceptor, the toner particles are attracted to the latent images, and, thus, the images are developed. The developed images are transferred onto plain paper and fixed thereon by heating.

Generally, such a dry developer has difficult-to-solve problems such as toner filming on the carrier beads and throwing-off of the toner particles during agitation of the developer in a developing station. Here, the term "throwing-off" means that the toner particles are thrown out from the developing station and scattered during the rotation of the magnetic roll of the developing station by moving air, centrifugal force, or mechanical shock.

Toner filming occurs due to a number of collisions between the toner particles and the carrier during recycling of the carrier. The attendant mechanical friction causes the toner material to partly melt and stick on the surface of the carrier beads, thus forming a film of toner thereon. Toner filming impairs the normal triboelectric charging of the toner particles in the developer, because the normal toner-carrier triboelectric charging is partly replaced by a toner-toner relationship. The improperly charged toner particles can be deposited on the non-image areas, whereby the quality of the printed mater is impaired, because the non-image areas possess an unacceptable darkness of background.

When the toner filming grows to a certain degree, the entire developer must be replaced, thereby increasing the cost of operation of a development apparatus. Furthermore, the replacement is time consuming. This is especially significant in a high speed printer.

The throwing-off problem occurs due to weak electrostatic charging between the toner particles and the carrier beads. When the developer material is vigorously agitated in the developing station, the toner particles are attracted to and adhered on the carrier beads. However, some of the toner particles are apt to separate from the carrier and fly up to deposit on non-image areas of the photoreceptor, and also, on the interior of the printer. As a result, fogging of the images occurs and the performance of the optical system, including the corotron, is impaired. Consequently, the electrostatic charging must be large enough to avoid throwing-off of the toner particles.

It is well known that carrier beads can be coated with a resin so as to reduce the formation of toner filming.

However, the resin must be easily and uniformly coated on the surface of the carrier beads and firmly fixed thereon.

The coated carrier beads and the toner particles are required to exhibit at least the following features during operation:

(A) The carrier beads must effect the necessary triboelectric charging of toner particles and a sufficient number of toner particles must be held on the coated surface of the carrier beads to exhibit a high optical density of the images and, also, to reduce the throwing-off of the toner particles so as not to cause fogging of the images.

(B) The coating resin must not peel off from the carrier beads and must be resistant to abrasion. Even if the coating chips, flakes, or spalls, the resulting fine powder must not cause fogging of the images and corrosion of the developing station, and toxic materials must not be released.

(C) The resinous material of the toner particles must not stick to the coating resin during agitation, that is, must reduce the formation of undesirable toner filming which impairs the normal triboelectric charging. In order to improve the resolution, toner particles must not blot on the paper during fusing of the binder of the toner.

(D) The resinous material of a toner particle must not stick to that of other toner particles, that is, must reduce blocking of the toner particles.

Prior art developers for use in an electrostatic high speed printer did not satisfy all of features (A) through (D) above, although several patents disclose methods of improving the behavior of either the toner or the carrier. For example, carrier beads are coated with a fluorine-containing polymer and a modifying material which are physically mixed with each other. It is necessary in order to obtain a uniform coating that a diluted formulation of the polymer, which includes chromium oxide, be sprayed onto the carrier beads suspended in a cyclic fluidized bed tower. The process is complicated.

Also, in the prior art, the ratio of toner weight to carrier weight has been generally used to control the ratio of toner charge to toner mass. However, we found that such a weight to weight ratio has certain disadvantages when we define in detail the ratio of toner charge to toner mass. From a practical viewpoint, both the toner and carrier may exhibit various densities and shapes, as they are produced from various materials. For example, new techniques using flash fusible toners, resin-coated carriers, and carriers having nonsphericity have been developed in electrophotography.

SUMMARY OF THE INVENTION

An object of the present invention is to provide a process for preparing an electrostatic developer which is capable of producing printed images with a high optical density.

Another object of the present invention is to provide a process for preparing an electrostatic developer which is capable of producing printed images with a high resolution.

Still another object of the present invention is to provide a process for preparing an electrostatic developer, the toner particles of which are fixed by irradiation with visible light having an ultraviolet component.

Yet another object of the present invention is to provide a process for preparing an electrostatic developer which can prevent the throwing-off of the toner particles from the surface of the carrier so that the background of the printed images is clear.

Still yet another object of the present invention is to provide a process for preparing an electrostatic developer, particularly a coated carrier, which can be produced without difficulties.

A further object of the present invention is to provide a process for preparing an electrostatic developer which can prevent formation of toner filming on the surface of the carrier so that the carrier has a long operational life.

A yet further object of the present invention is to provide a process for preparing an electrostatic developer which can prevent blocking of toner particles.

A still further object of the present invention is to provide a process for preparing an electrostatic developer, the toner of which, particularly the colorant of the toner, is stable during storage and does not produce toxic or harmful materials during printing.

According to the invention, there is provided a process for preparing a developer for electrostatic images, comprising a mixture of (1) a coated carrier and (2) a toner, comprising three steps.

The first step comprises immersing carrier beads in an organic solution of a resin comprising a butadiene homopolymer, i.e., 1,2-polybutadiene or cyclized cis-1,4-polybutadiene or a mixture thereof. Alternatively, the organic solution comprises a mixture of at least one of the homopolymers and a styrene butadiene copolymer, each homopolymer having a molecular weight of from 10,000 to 100,000, the mixture containing from 7.5% to 100%, based on the weight of the mixture, of butadiene in polymerized form. The first step further comprises evaporating the organic solvent of the solution, drying the immersed beads, and curing the resin by a rotary drying method. The rotary drying method comprises placing the immersed beads in a vessel and heating them while the vessel rotates so as to avoid the aggregation of the coated carrier particles with each other. Thus, a resin coating is formed on the carrier beads.

The second step comprises blending toner materials at a temperature sufficient to form a toner mass. The toner materials comprise (a) from 85% to 95% of a binder resin, based on the weight of the toner materials, comprising, based on the weight of the binder resin, from 50% to 100% of an epoxy resin of a molecular weight of from 900 to 8,000 and from 0% to 50% of a styrene alkyl methacrylate copolymer, the alkyl group having from 1 to 4 carbon atoms, being of a molecular weight of from 10,000 to 100,000; (b) a colorant comprising, based on the weight of the toner materials, from 0% to 10% of fine carbon and from 0.5% to 8% of a nigrosine dye; and (c) from 0% to 8% of a charge controlling agent, based on the weight of the toner materials, wherein the charge controlling agent comprises a control material which is a quaternary ammonium alkyl sulfonate, the alkyl group having from 4 to 20 carbon atoms, di-(poly-hydroxy ethoxy ethyl) octadecyl amine, or a polyamine.

The third step comprises pulverizing the blended toner mass to form toner particles and mixing the obtained toner particles with the coated carrier, the ratio of the total surface area of the carrier to the total projection area of the toner particles being in the range of from 1:0.5 to 1:2.0.

DESCRIPTION OF THE PREFERRED EMBODIMENTS

According to the present invention, there is provided a process for preparing a developer for electrostatic images comprising: (1) immersing carrier beads in an organic solution of a resin material comprising a butadiene homopolymer, or a mixture of at least one of the homopolymers and a styrene butadiene copolymer; evaporating the organic solvent of the solution, drying the immersed beads, and curing the resin material by a rotary drying method, to form a resin coating on the carrier beads; (2) blending toner materials at a temperature sufficient to form a toner mass, the toner materials comprising: (a) a binder resin, (b) a colorant, and (c) a charge controlling agent; and (3) pulverizing the blended toner mass to form toner particles and mixing the obtained toner particles with the coated carrier.

The butadiene homopolymer of the resin material according to the present invention comprises 1,2-polybutadiene or cyclized cis-1,4-polybutadiene. Cyclized cis-1,4-polybutadiene is a partially cyclized linear polymer having fewer double bonds than 1,2-polybutadiene, because they are partly opened by cyclization. After curing, cyclized cis-1,4-polybutadiene can form a three-dimensional structure having a lower cross-linking density and the resultant coating thereof is softer than that formed by 1,2-polybutadiene. Therefore, it is possible to blend these two types of polybutadienes so as to obtain a desired hardness of the coating.

Figure 1:
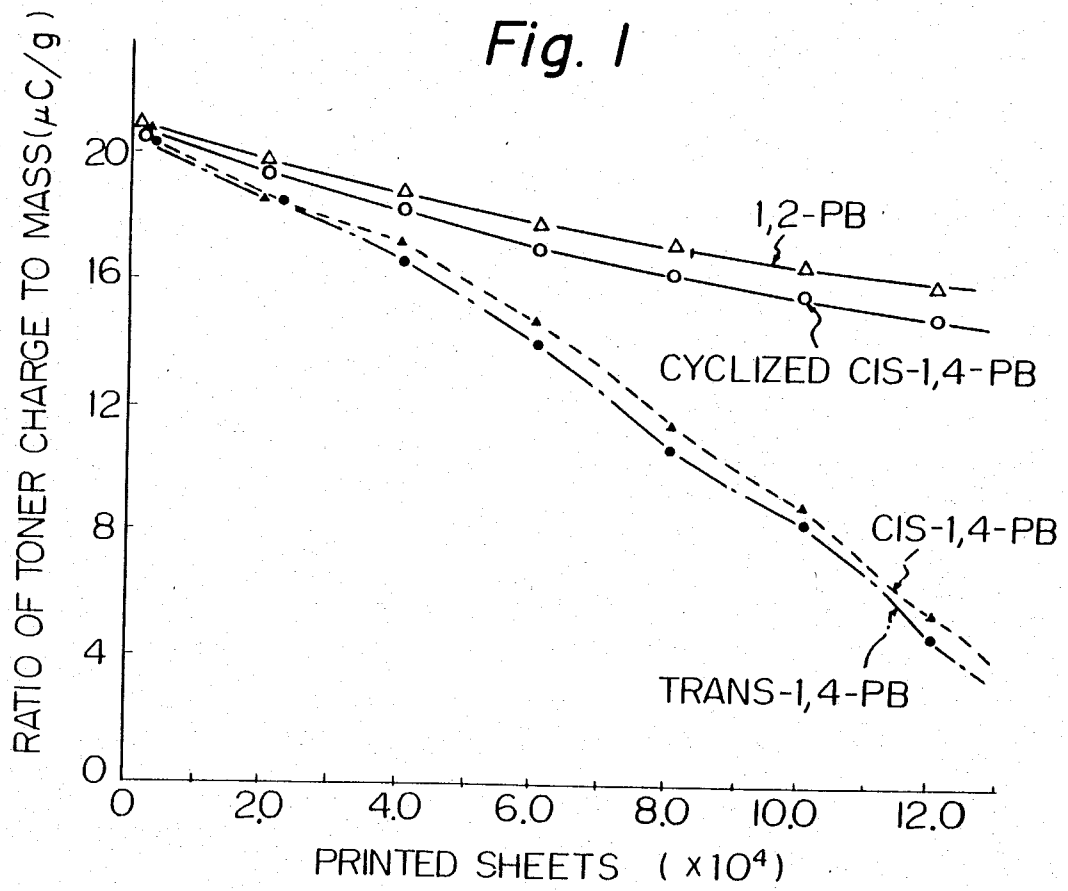
FIGS. 1 and 2 show the relationship between four species of polybutadiene and the ratio of toner charge to mass and amount of toner filming as a function of the number of printed sheets.
Figure 2:
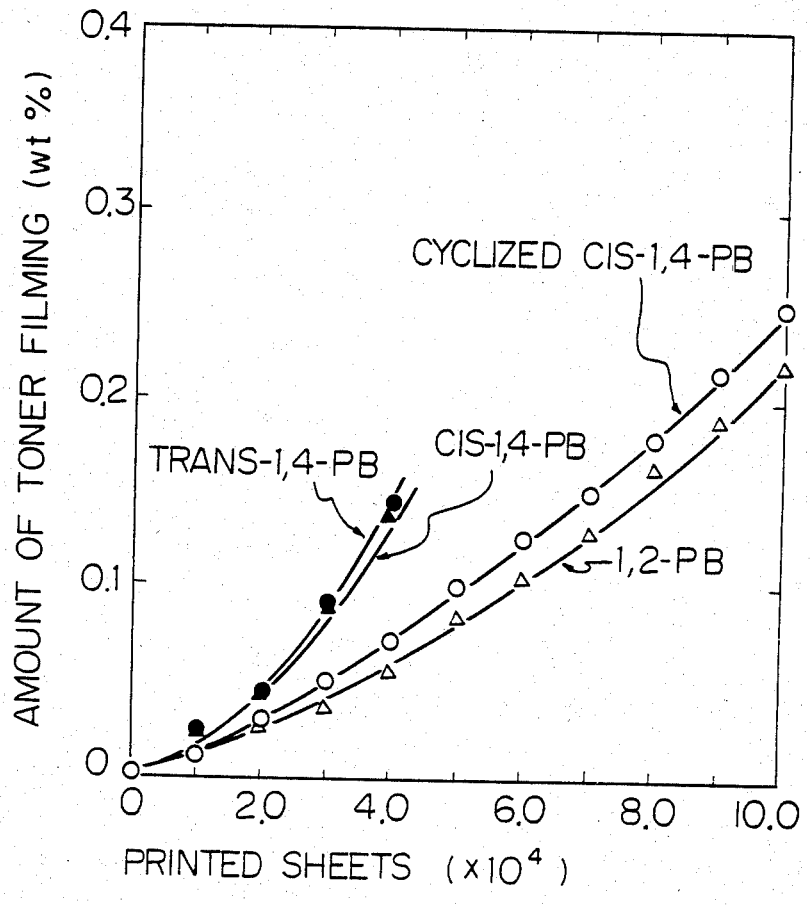
Figure 3:
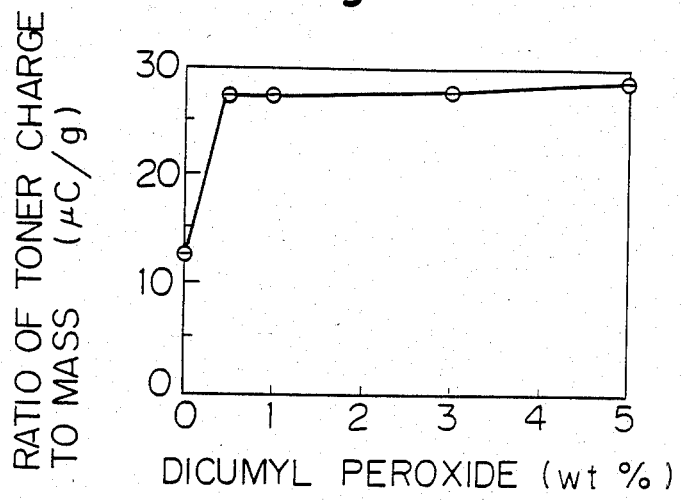
FIGS. 3 and 4 show the ratio of toner charge and amount of toner filming as a function of the amount of dicumyl peroxide.
Figure 4:
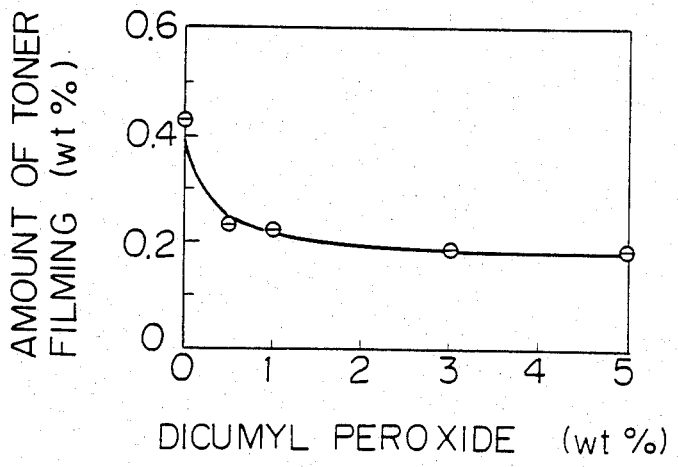

A carrier coated with a resin containing such butadiene in polymerized form exhibits a higher triboelectric property and less tendency toward toner filming than a carrier coated with another of polybutadiene, such as cis-1,4-polybutadiene and trans-1,4-polybutadiene, as shown in FIGS. 1 and 2. Furthermore, when from 0.1 to 10 parts by weight, preferably from 0.5 to 5 parts by weight, of an organic peroxide, preferably dicumyl peroxide, based on 100 parts of the weight of the resin, is added to the resin solution, dried, and cured, the triboelectric property and toner filming are further improved, as shown in FIGS. 3 and 4.

Such a carrier can be easily produced by mixing the resin with an adequate organic solvent and drying the mixture using a rotary drying method. In the rotary drying method, the immersed beads are placed in a vessel and heated while the vessel rotates, thereby avoiding aggregation of the coated carrier beads.

The inventors found that 1,2-polybutadiene and cyclized cis-1,4-butadiene having a molecular weight of 10,000 to 100,000 (number average molecular weight, same below) are easily dissolved in an organic solvent and, in addition, have high hardness after curing. Cyclized cis-1,4-polybutadiene requires the shortest time for going into solution and thereby is most easily handled for preparing a coated carrier, whereas 1,2-polybutadiene exhibits the highest hardness and, consequently the lowest stickiness, after the carrier beads are coated therewith.

On the other hand, cis-1,4 polybutadiene and trans-1,4 polybutadiene exhibit a rubber-like structure and a poor solubility. Therefore, as the solvent vaporizes during the coating process, they exhibit high viscosity which leads to undesirable aggregation of the carrier beads.

The coating resin according to the present invention comprises such a butadiene homopolymer of a molecular weight of from 10,000 to 100,000 or a mixture of such a butadiene homopolymer and a styrene butadiene copolymer of a molecular weight of from 10,000 to 100,000, the mixture containing from 7.5% to 100%, based on the weight of the mixture, of butadiene in polymerized form.

The coating resin may contain more than 90% by weight of butadiene in polymerized form, based on the weight of the coating resin. The coating resin may further comprise less than 10% of a fluorine-containing polymer, based on the weight of the coating resin, so as to further reduce the tendency of the coating resin to stick to the toner resin.

The carrier beads may be spherical shot, preferably having recesses on their surface, for instance in the form of thin plate-like flakes or thick flakes. When the beads are made from iron, their surface is usually oxidized to a bluish color. The size of the beads is determined by the size of the toner particles to be mixed therewith. The size of the toner particles is usually from 5 to 30 μm. The size of the carrier beads may be from 20 to 500 μm, preferably from 100 to 250 μm. Carrier beads smaller than 30 μm cannot flow with the toner particles smoothly. Carrier beads over 500 μm cannot hold enough toner particles per unit weight.

The thickness of the coating resin according to the invention is from 0.3 to 20 μm, preferably from 0.7 to 2.0 μm. If the coating resin is thicker than 20 μm, the coated carrier beads tend to stick to each other, whereas the surface of beads coated with a resin layer thinner than 0.3 μm will be partly uncovered.

The toner material comprises from 85 to 95% by weight of a binder resin and from 0% to 8% by weight of a charge controlling agent, based on the weight of the toner.

The binder resin of the toner comprises from 50% to 100% by weight of an epoxy resin of a molecular weight in the range of from 900 to 8,000 and forms less toner filming than a binder resin comprising less than 50% by weight of an epoxy resin. Therefore, the image exhibits a high optical density. At the time of fusing, fused toner particles are apt to broaden the printed area, thereby lowering the resolution of the printed images. Therefore, from 0% to 50% by weight of a styrene alkylmethacrylate copolymer is added, which has a higher viscosity in the fused state. The copolymer should have an alkyl group having from 1 to 4 carbon atoms and be of a molecular weight from 10,000 to 100,000.

It is convenient to fuse the toner particles adhered on the latent images by visible light with an ultraviolet component, without using a heating roll or a heating oven. Such a flash-fusible toner comprises a bis-phenol A epichlorhydrin type epoxy resin, wherein the amount of monomeric bis-phenol A glycidyl ether must not exceed 4% by weight, so as to restrain the increase of toner filming and rapid decrease of toner charge. Such an epoxy resin must not decompose at all, but must easily melt during irradiation. Thus, it is preferable to limit the epoxy equivalent to the range of from 450 to 5,500 and a melting point of from 60° C. to 160° C.

It is preferable that the toner contain montan wax so as to reduce blocking of toner particles with each other. However, when a toner contains more than 1% by weight of montan wax, it tends to excessively diffuse on the paper sheet at fixation of the toner and, thus, to lower the printing quality.

The colorant comprises from 0% to 10% of fine carbon and from 0.5% to 8% of a nigrosine dye, based on the weight of the toner. Carbon is a nontoxic and stable colorant. However, a transparent resin in which this black pigment is dispersed reflects the light irregularly on the surface of the toner. In order to make the color of toner deep, a bluish nigrosine dye is mixed with the binder resin.

The electric conductivity of carbon reduces the triboelectric charge and, thereby, a toner containing carbon has a tendency to be thrown off from the surface of the carrier during agitation in the developing station. In order to compensate for the electric conductivity of carbon, a charge controlling agent is added to the toner resin. The charge controlling agent may be a quaternary ammonium alkylsulfonate, the alkyl group having from 4 to 20 carbon atoms, di-(poly-hydroxy ethoxy ethyl) octadecyl amine, or a polyamine. The polyamine may be a polyolefin polyamine of a molecular weight of from 1,000 to 100,000, expressed by the formula:

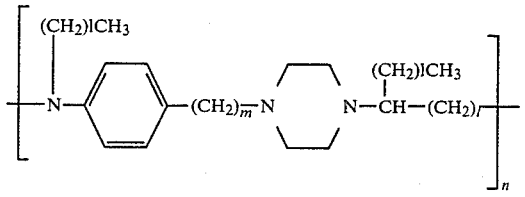

where l=0 or 1 and m=1 or 2.

In pulverizing the blended toner mass to form toner particles and mixing the obtained toner particles with the coated carrier, the ratio of the total surface area of the carrier to the total projection area of the toner particles is kept in the range of from 1:0.5 to 1:2.0. Here, the term "projection area of the toner particles" means the shadowing area occupied by these toner particles.

The ratio of toner projection area to carrier surface is used for control of the ratio of toner charge to toner mass. The ratio of toner charge to toner mass is proportional to the product of the surface charge density of toner ($\sigma$) and the total surface area of toner particles. The surface charge density of toner ($\sigma$) is in turn, proportional to the carrier surface which is occupied by the toner particles. The carrier surface area occupied by toner particles is, in turn, determined by the reciprocal $1/\eta$ of the ratio of the total projection area of toner particles to the total surface area of carrier beads ($\eta$).

Figure 5:
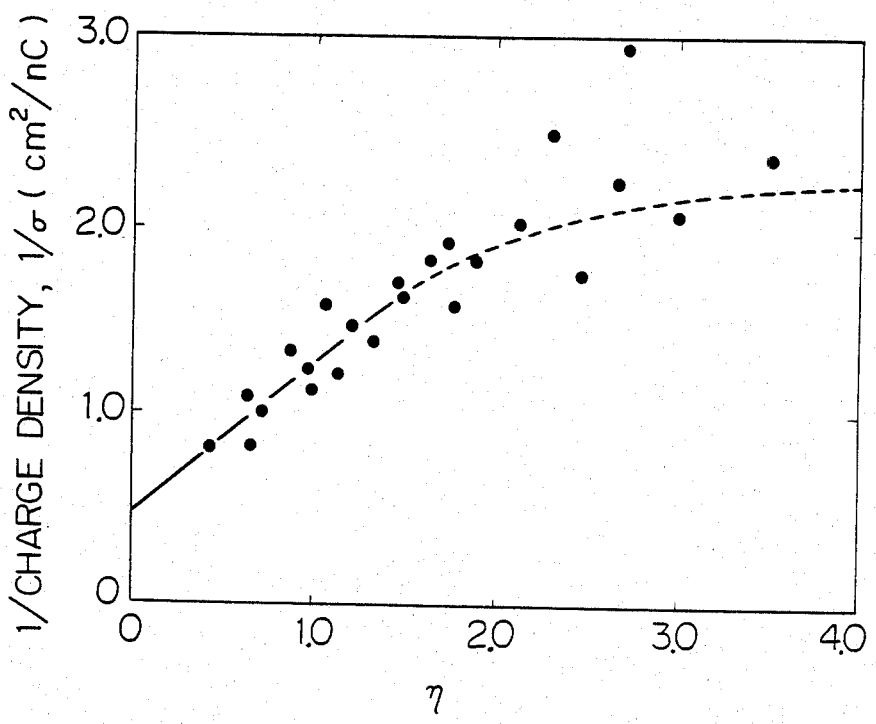
FIG. 5 shows the reciprocal of charge density as a function of the ratio $\eta$.

According to the present invention, the relation between the surface charge density of toner ($\sigma$) and the coverage ratio of the surface area of the carrier covered by toner particles ($\eta$) is shown in FIG. 5. Referring to FIG. 5, it was found that the reciprocal $1/\sigma$ of the surface charge density of toner ($\sigma$) is proportional to the ratio of the total projection area of toner particles to the total surface area of carrier beads ($\eta$), in the case when $\eta$ is less than 2.0. In making up developers, when too many toner particles are mixed with the carrier beads so that $\eta$ becomes greater more than 2.0, the points of $1/\sigma$ deviate from the curve, as shown in FIG. 5. This deviation can be explained by the fact that when toner particles occupy the entire surface of the carrier, the excess toner particles will partly flow away from the carrier due to the vibrating motion during the mixing the toner particles with the carrier. Such excess toner particles applied in an actual developing instrument are apt to deposit on the interior of the printer, which leads to deterioration in the quality of the printed matter.

When suitable amounts of toner particles are applied to the carrier beads, the toner charge acts to neutralize the carrier charge as a whole. The opposite charge to the charge of toner will remain on the carrier surface, after the toner particles flow away form the carrier. When too small an amount of toner particles is used, i.e., $\eta$ is less than 0.5, the carrier surface is only partly covered by the adhered toners, and such a carrier, in turn, will adhere due to its charge being opposite to the charge of the photoreceptor, on a region of the surface of the photoreceptor where deep background potential is generated along the edge of the latent image. Therefore, such a carrier bead will be an obstacle to accurately transferring the toner image on printed matter.

We conclude that the toner content of the developer should be controlled by the ratio of the total surface area of the carrier beads to the total projection area of toner particles ($1/\eta$) and that the optimum value of $\eta$ should fall within the range of from 0.5 to 2.0 because the developer differs in size distribution and the shape diversification of toner particles and carrier beads.

The present invention will be better understood by the following examples, which by no means limit the invention.

Coating Resin of Carrier

Example 1

Four samples of coated carrier were prepared by dissolving 100 g each of the cyclized cis-1,4-polybutadiene, 1,2-polybutadiene, cis-1,4-polybutadiene, and trans-1,4-polybutadiene shown in Table 1 and by stirring 4 kg of trichloroethylene into each sample in a pot mill rotating at 5 rpm. The length of time required for dissolving each sample is shown in Table 2. Further, 1.5% by weight of benzoyl peroxide based on the weight of the resins was added to each of cyclized cis-1,4-polybutadiene, 1,2-polybutadiene, cis-1,4-polybutadiene, and trans-1,4-polybutadiene solutions.

TABLE 1

| Polybutadienes | |
|---|---|
| Cyclized cis-1,4-polybutadiene | CBR-L, Nihon Gosei Gomu K.K. |
| 1,2-polybutadiene | Dienite, Firestone Synthetic Rubber & Latex Co., Ltd. (Molecular weight 10,000 to 100,000) |
| Cis-1,4-polybutadiene | BRO2LL, Nihon Gosei Gomu K.K. |
| Trans-1,4-polybutadiene | Diene 35A, Firestone France S.A. |

Each sample then was cast by pouring so as to form a sample plate of 1 mm thickness and then was cured by heating at 170° C. in air for 2 hours. The cured resinous plates were tested by means of a Barcol hardness tester in accordance with Japanese Industrial Standard (JIS) K 6911. The determined hardness of each sample is also shown in Table 2.

TABLE 2

| Solubility and Hardness of Polybutadiene Species | Solubility (h) | Hardness |
|---|---|---|
| Cyclized cis-1,4-polybutadiene | 5 | 30 to 40 |
| 1,2-polybutadiene | 10 | 40 to 50 |
| Cis-1,4-polybutadiene | >30 | <5 |
| Trans-1,4-polybutadiene | >30 | <5 |

Example 2

A 15 kg amount of spherical iron shot (Nihon Teppun K.K., ST-200), having an average diameter of about 150 μm, was added in each solution of the four species of polybutadiene prepared as set forth above. Coating of the carrier was carried out by the rotary drying method according to the present invention. Thus, the solution was placed in an exhaustable drum. As the drum rotated between 1 and 2 rpm, the solvent was vaporized and exhausted during rotation at room temperature. After almost all the solvent had evaporated, the coated carrier was dried at 110° C. for one hour and was cured at about 190° C. for two hours while rotating. Each of the four coated carriers was mixed with toner particles, wherein the ratio of surface of the carrier to total projection area of the toner was about 1:1. The composition of the toner was as shown in Table 3. The thusly formed developer was subjected to a printing test under the conditions shown in Table 4.

TABLE 3

| Composition of Toner | | |
|---|---|---|
| Binder resin | Epoxy resin (softening point 70° C., melting point 80° C.) | 87 wt % |
| Carbon | Long flow carbon | 5 wt % |
| Dye | Nigrosine based dye | 5 wt % |
| Charge controlling agent | Polyolefin polyamine | 3 wt % |

TABLE 4

| Printing Condition | |
|---|---|
| Ratio of surface of carrier to total projection area of toner | About 1:1 |
| Development | Magnetic brush process |
| Developing speed | 38 cm/s |
| Photoreceptor | ZnO masterpaper |
| Temperature | 23° C. to 25° C. |
| Humidity | 35% to 74% R.H. |
| Fusion | Heating Oven |

The ratio of toner charge to mass, i.e., the specific electrostatic charge (μC) deposited in 1 g developer, and the amount of toner filming, i.e., weight ratio of toner electrostatically deposited on the surface of the carrier, were estimated during the printing.

FIG. 1 shows the relationship between ratio of toner charge to mass and number of printed sheets. Cyclized cis-1,4-polybutadiene and 1,2-polybutadiene are again demonstrated to be decidedly and unexpectedly superior also for this critical property for the coating resins, as compared to the other polybutadiene homopolymers such as cis-1,4-polybutadiene and trans-1,4-polybutadiene.

The experimental results shown in FIG. 2 demonstrate the decidedly superior nonsticky properties, i.e., less tendency of toner filming of the particular homopolymers of the present invention, i.e., 1,2-polybutadiene and cyclized-cis-1,4-polybutadiene as compared with the other polybutadiene homopolymers such as cis-1,4-polybutadiene and trans 1,4-polybutadiene.

Example 3

A toner resin was fused on a styrene butadiene coating resin which had been coated on an iron plate. Then, the layer of toner resin was peeled off from the coating resin, and the area of the peeled off toner resin in the interface between the toner and the coating resins was measured and expressed in percentage. The higher the butadiene content of the coating styrene butadiene copolymer, the more improved the peeling-off ratio, namely, the nonstickiness. However, the solubility of the copolymer in chloroform decreased as shown in Table 5, and, as a result, coating became more difficult.

TABLE 5

| | Butadiene Content of Coating Resin | | | | |
|---|---|---|---|---|---|
| | Coated resin | | | | Bare iron |
| Butadiene content (wt %) | 0 | 1 | 7.5 | 20 | — |
| Ratio of peeling (%) | 60 | 70 | 92 | — | 0 |
| Solubility in chloroform | O | O | O | X | — |

Note:
O . . . good, X . . . poor

Example 4

Cyclized cis-1,4-polybutadiene, which exhibited good solubility, was mixed with styrene butadiene copolymer containing 7.5% by weight of butadiene in polymerized form. A 35 g amount of 1,2-polybutadiene, 100 g of cyclized cis-1,4-polybutadiene, and 15 g of styrene butadiene copolymer containing 7.5% of butadiene in polymerized form were dissolved in 3 kg of trichloroethylene. A 15 kg amount of spherical iron shots (Nihon Teppun K.K., ST-200), having a size of 100 to 240 μm were added to the resulting solution in an exhaustable drum. As the drum rotated between 1 and 2 rpm, the content was uniformly mixed, and the evaporating vapor was exhausted during rotation. When the solvent had almost completely evaporated, the coated carrier beads were removed to another rotary drum and dried at 110° C. for one hour, then heated at 200° C. for one hour while mixing, so as to cure the coating resin.

The obtained coated carrier was mixed with toner particles having the composition described in Table 3 and subjected to a printing test under conditions described in Table 4. The printing performance was as preferable as that of cyclized cis-1,4-polybutadiene.

Example 5

As the butadiene content in styrene butadiene copolymer was increased, the solubility was lowered, as shown in Table 5. Cyclized cis-1,4-polybutadiene (CBR-L, Nihon Gosei Gomu K.K.), which exhibited good solubility, was mixed with styrene butadiene copolymer containing 7.5% by weight of butadiene in polymerized form. A 35 g amount of 1,2-polybutadiene, 100 g of cyclized cis-1,4-polybutadiene, and 15 g of styrene butadiene copolymer containing 7.5% of butadiene in polymerized form were dissolved in 3 kg of trichloroethylene. A 15 kg amount of fine spherical shot of bluish oxidized iron, having a size of 100 to 240 μm, was added to the resulting solution in a drum and mixed therewith.

The solvent in the solution was evaporated by the rotary drying method. As the drum rotated between 1 and 2 rpm, the content was uniformly mixed, and the evaporating vapor was exhausted during rotation. When the solvent had almost completely evaporated, the coated carrier beads were dried at 110° C. for one hour, then heated at 180° C. for two hours, so as to cure the coating resin. The beads were coated to a thickness of about 1 μm.

The obtained coated carrier beads were mixed with the toner having the composition described in Table 3. A printing test was carried out under the conditions described in Table 4. The developer was put in a magnetic brush development apparatus. Test patterns were developed and transferred onto plain paper, and fused thereon by heating. The optical density of the printed images was determined. The optical density was more than 1.5, even when printing was continued for over 400 hours.

Figure 6:
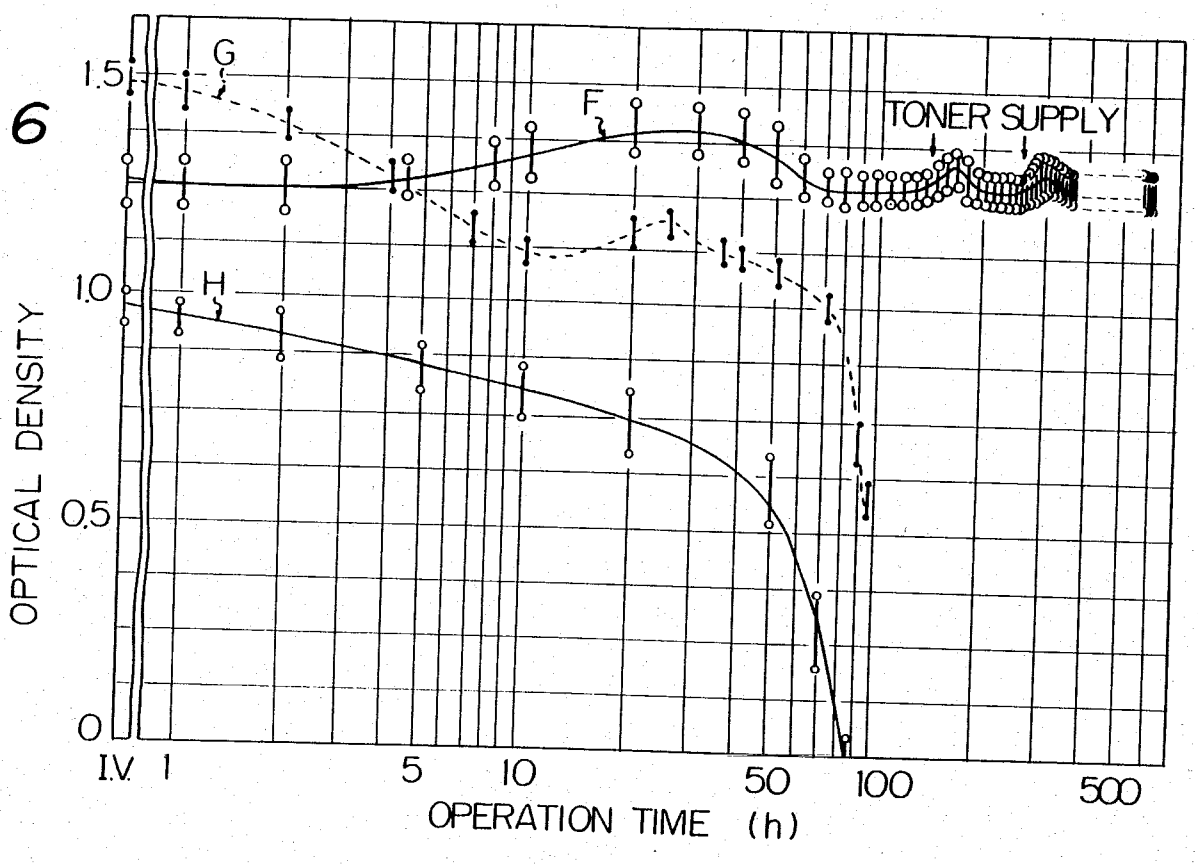
FIG. 6 shows the optical density of an image as a function of operating time.

The optical density of the images using this developer is shown as curve F in FIG. 6.

Example 6

A nonsticky styrene butadiene copolymer of a 7.5% butadiene content was used for the preparation of a coated carrier. Spherical iron beads (Kanto Denka K.K., Air Atomized Spherical Powder ST-200) were used as the carrier. A 150 g amount of the resin was introduced into 3 kg of chloroform in a 20 l exhaustable rotary drum. After the resin was completely dissolved, 15 kg of iron beads of 50 to 200 μm were poured into the drum. The mixture was dried by the rotary drying method, i.e., dried at 110° C. for one hour, and then heated at 200° C. for one hour so as to cure the coating resin in the rotating drum.

The obtained coated carrier was mixed with toner particles having the composition described in Table 3 and subjected to a printing test under conditions described in Table 4. The printing performance was found to be stable.

Further, when thin plate-like iron flakes (Nihon Teppun K.K., EFV 100/200), thick iron flakes (Dowa Teppun K.K., DSP-128B), or glass beads were used as core particles, the results obtained were similar to the case of spherical iron beads.

Example 7 (Comparative)

Other developers were used in a printing test as a comparison. The operational conditions were the same as in Example 6. Curve H, in FIG. 6, represents the optical density obtained by a prior art toner and a bare carrier of iron beads, and curve G, in FIG. 6, represents that obtained by the toner having the composition described in Table 3, and a bare carrier of thick iron flakes (DSP-128B).

Coating Resin of Carrier and Binder Resin of Toner

Example 8

A 100 g amount of 1,2-polybutadiene having an average molecular weight of about 100,000 (Nihon Gosei Gomu K.K., JSR-RB810) and 0.5 g of dicumyl peroxide were dissolved in 5 kg of trichloroethylene so as to form a resin solution. A 5 kg amount spherical iron shot having average diameter of 150 μm (Nippon Teppun K.K., ST-200) was mixed with the resin solution in a drum, which rotated at from 1 to 2 rpm, while the vapor was evaporated at room temperature and exhausted. After almost all the solvent evaporated, the iron shot coated with the resin were delivered to another drum, which rotated at from 1 to 2 rpm, and cured at about 190° C. for 2 hours. The carrier beads were coated with from 1 to 3 μm of thick 1,2-polybutadiene, without coagulation of particles.

A 92.5 g amount of bis-phenol A epichlorohydrin-type epoxy resin, which has weight average molecular weight of 1,400, epoxy equivalent of 950, and melting point of 100° C. and contains about 3.0% by weight of monomeric bis-phenol A glycidyl ether, was mixed with 3 g of carbon black (Cabot Co., Black Pearls L), 5 g of nigrosine dye (Orient Kagaku K.K., Oil Black BY), and 0.5 g of montan wax (Hoechst A.G., Ester Wax E) in a kneader at 100° C. The obtained mass was ground in a jet-pulverizer and toner particles having average size of about 10 μm were selected in a blowing classifier.

This toner was mixed with the carrier set forth above so as to obtain a developer A, which has a ratio of surface of carrier to total projection area of toner of about 1:1. This developer was tested under the printing condition shown in Table 5.

TABLE 5

| Printing Condition | |
|---|---|
| Ratio of surface of carrier to total projection area of toner | About 1:1 |
| Development | Magnetic brush process |
| Developing speed | 54 cm/s |
| Photoreceptor | Se drum |
| Temperature | 23° C. to 25° C. |
| Humidity | 35% to 74% R.H. |
| Fusion | Flashing Fixation |
| Printing speed | 6 lines/min; 10,600 lines/inch |
| **Evaluation** | |
| Optical Density of Fused Image | |
| Toner Filming on Carrier | |
| Toner Filming on Se Drum | |
| Ratio of Toner Charge to Mass | |

After 200,000 sheets were printed, the parameters of the developer were estimated.

Figure 7:
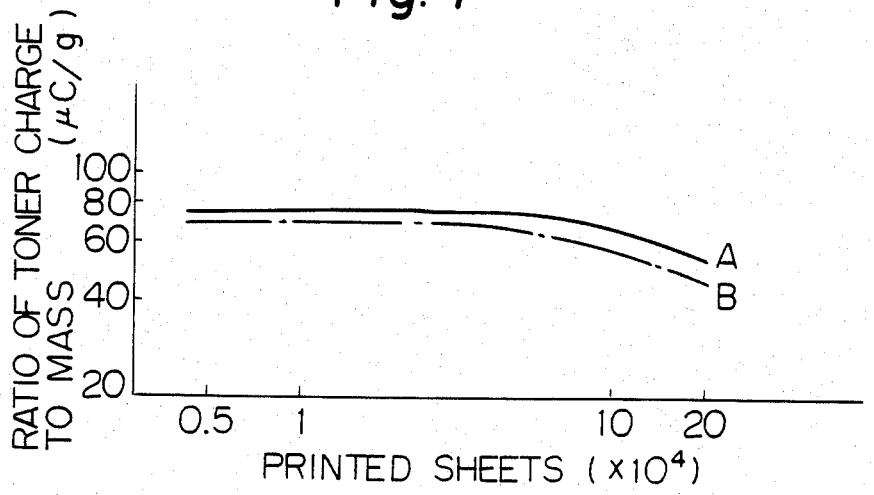
FIGS. 7 and 8 show the ratio of toner charge to mass and amount of toner filming as a function of the number of printed sheets.
Figure 8:
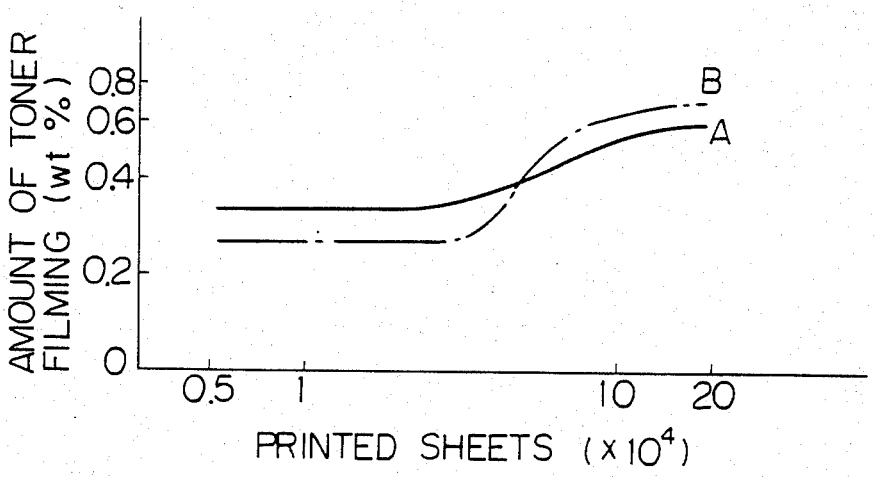

The initial resolution of 12 lines/mm and the initial optical density of more than 1.2 were maintained. The ratio of toner charge to mass and amount of toner filming were 55 μC/g and about 0.6% by weight, as shown in lines A of FIGS. 7 and 8, respectively.

Example 9

A carrier was coated under similar conditions as Example 5, except that 100 g of cyclized 1,4-cis-polybutadiene (Nihon Gosei Gomu K.K., CBR-L) having a cyclization ratio of about 60% and 1 g of dicumyl peroxide were dissolved in the solvent. A printing test was carried out in the same condition as described in Table 5. After 200,000 sheets were printed, the ratio of toner charge and amount of toner filming were 45 μC/g and 0.7% by weight, as shown in lines B of FIGS. 6 and 7, respectively.

Binder Resin of Toner

Example 10

A toner was prepared with a mixture of 90% by weight of an epoxy resin $E_p$ 1004, 5% by weight of long flow carbon, and 5% by weight of a nigrosine dye (Oil Black BY). The preparation procedure was as follows. The binder, carbon, and dye were introduced in a kneader, mixed therein at 100° C. for an hour, and cooled naturally for 12 hours. The obtained mass was ground sequentially by a jaw crusher, a centrifugal mill, and a jet pulverizer, and the resulting particle of 5 to 25 μm were separated as toner with a blowing classifier.

Bare plate-like iron beads of 100 to 200 mesh were used as the carrier, which was not coated with a resin.

Printing experiments were then carried out under the conditions described in Table 4.

Figure 9:
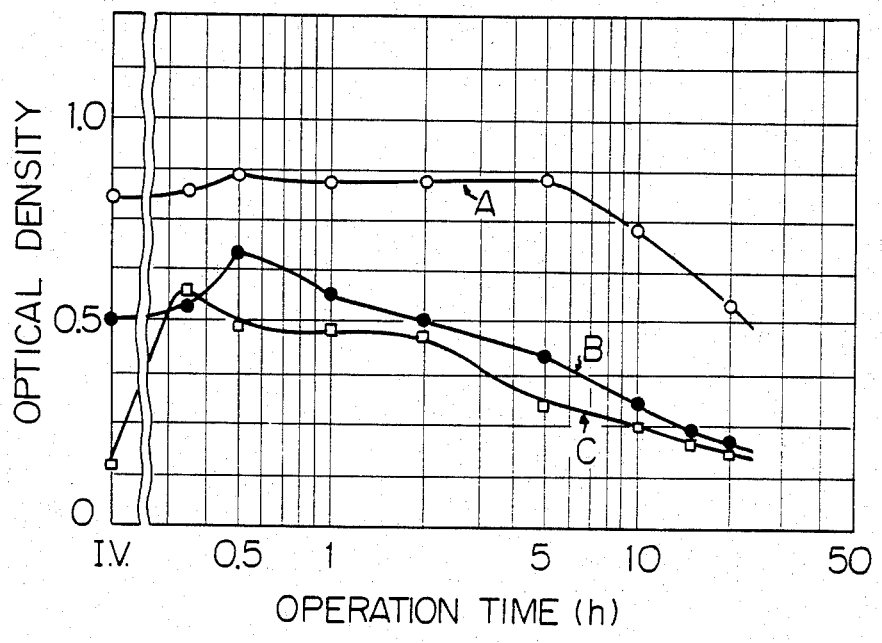
FIG. 9 shows the optical density of a fused image as a function of operating time.

The optical density evaluated at regular time intervals was as shown by curve A in FIG. 9.

Example 11

Three types of toner were prepared in a manner similar to that of the toner of Example 10, except that 5 to 20% of a higher molecular weight epoxy resin, based on the weight of the resin, such as $E_p$ 1007 (molecular weight 1700, epoxy equivalent 1750 to 2100) or $E_p$ 1009 (molecular weight 3750, epoxy equivalent 2400 to 3000) was added to $E_p$ 104 (molecular weight 1400, epoxy equivalent 900 to 1000). The fusing of the toner was successfully improved.

Example 12 (Comparative)

Two types of toner were prepared in a manner similar to that of the toner of Example 9, except that the binder was replaced by (B) a styrene-based resin (Pennsylvania Industrial Chemicals Co., Piccolastic D 100) or (C) a styrene butadiene copolymer resin (Nihon Zeon K.K., 2007 J), containing 85% of styrene in polymerized form, based on the weight of the toner.

Their optical density was shown by curves B and C in FIG. 9. These toners formed toner filming on the surface of the carrier and on the photoreceptor sheet and, in addition, exhibited a lower optical density than curve A of Example 10.

Example 13

An amount between 0 and 50% of a styrene alkylmethacrylate copolymer resin (Sanyo Kagaku K.K., Hymer SBM-600, molecular weight 60,000) was added to the epoxy resin, based on the weight of the binder resin. The resolution was improved to 10 lines/mm from 9 lines/mm obtained using only an epoxy resin. When the content of this copolymer resin exceeded 50% by weight, the toner exhibited an unfavorable adhesion to the photoconductive sheet ($PVC_z$-TNF-Polyester Binder).

Example 14

A mixture of 92% by weight of an epoxy resin (Dainihon Ink K.K., Epychlon 4050, epoxy equivalent 900 to 1,000, melting point 96° C. to 104° C., 5% by weight of carbon (Cabot Corp., Black Pearls L), having an average size of 24 nm, and nigrometer index 83), 2% by weight of a nigrosine dye (Orient Kagaku K.K., Nigrosine Black EX), and 1% by weight of di-(poly-hydroxy ethoxy ethyl) octadecyl amine was kneaded at 100° C., ground with a jet pulverizer, and separated with a blowing classifier, so as to obtain toner perticles. A xenon flash lamp (Ushio Denki K.K.) was mounted in a laser printer with a printing speed of 16 cm/s. Fusing was carried out at 300 J/pulse. During fusing, the fusing station of this printer was evacuated at a rate of 1 l/min. Organic vapors in the exhausted air were trapped by a molecular sieve and analyzed with a gas chromatospectrometer provided with an ion multiplier.

Example 15 (Comparative)

A mixture of 46% by weight of an epoxy resin (Dainihon Ink K.K., Epychlon 4050), 46% by weight of styrene butylacrylate copolymer resin (Sanyo Kasei Kogyo K.K., Hymer, molecular weight 60,000, softening point 140° C.), 2% by weight of carbon (Black Pearls L), and 6% by weight of Nigrosine Black EX (Orient Kagaku K.K.) was used to prepare toner particles in the same manner as described in Example 14. The toner particles were fused and analyzed in the same manner as in Example 14. The obtained printed matter exhibited an unfavorable odor.

Carbon and Dye of Toner

Example 16

Figure 10:
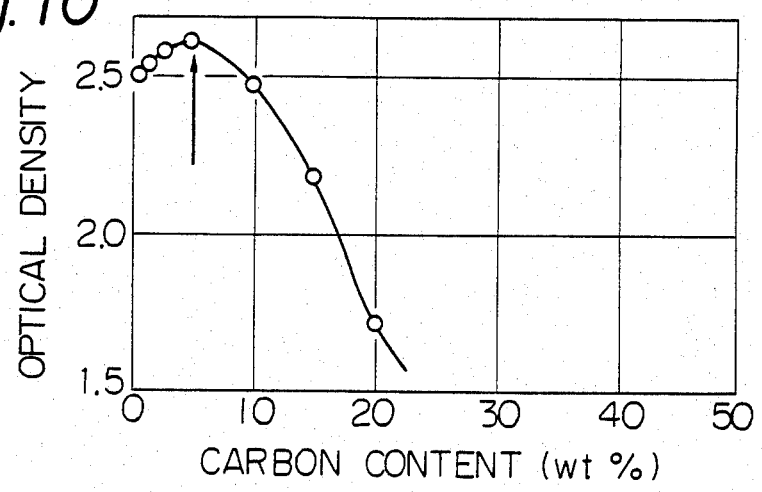
FIGS. 10 and 11 show the optical density and fusing temperature of a disc of fused epoxy resin as a function of carbon content.
Figure 11:
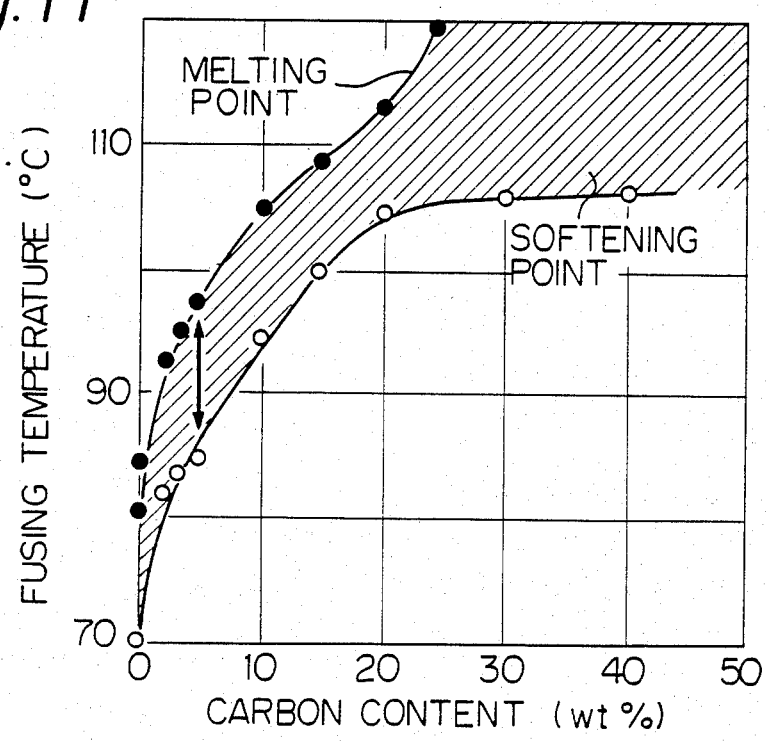

The optical performance of the toner components, such as colorants, are not seriously influenced by the type of a binder resin. Therefore, an epoxy resin (Dow Chemical Corp., $E_p$ 1004), and Long Flow Carbon (Black Pearls L, nigrometer index 83) were fused to shape a disc on plain paper. As shown in FIGS. 10 and 11, the optical density of the disc and the fusing temperature were plotted as the content of the carbon was changed. The toner containing 5% of carbon, based on the weight of toner, exhibited a high optical density and a low fusing temperature.

Example 17

Figure 12:
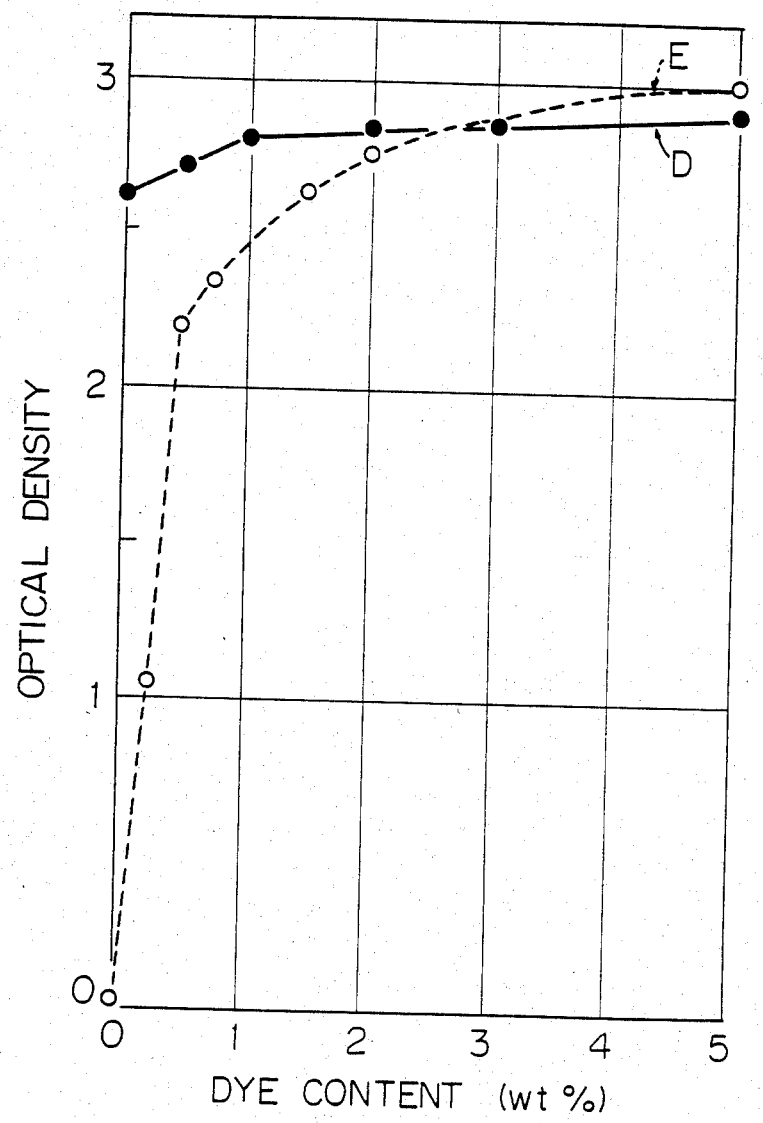
FIG. 12 shows the optical density of a disc of fused epoxy resin as a function of dye content.

The toner used in Example 16 was modified by adding a nigrosine dye (Orient Kagaku K.K., Oil Black BY) which does not contain a heavy metal, such as chromium. The optical density of a corresponding fused disc using this modified dye is shown as curve D in FIG. 12.

Example 18

A toner was prepared using the epoxy resin used in Example 15 and a nigrosine dye (Orient Kagaku K.K., Oil Black BY) only.

This toner, which did not contain carbon, but only the nigrosine dye, exhibited a deep tone. The optical density is as shown by curve E in FIG. 12.

Ratio of Total Surface of Carrier to Total Projecting Area of Toner Particles

Example 19

The mixing ratio of carrier to toner particles was determined as follows. The ratio $1/\eta$ of the total surface area of carrier beads to the total projection area of toner particles was determined from the distribution of size of toner particles and carrier beads. The triboelectric charge density $\sigma$ on the surface of the toner was determined. The relationship between $\eta$ and $1/\sigma$ was plotted. The toner had the composition described in Table 3, and the carrier beads were coated with a styrene butadiene copolymer having 7.5% of butadiene in polymerized form, based on the weight of the copolymer resin. The size distribution of the toner was 5 to 30 $\mu$m and that of the carrier 160 to 500 $\mu$m.

As shown in FIG. 5, when $\eta$ is less than 0.5, the development current could not be detected, and when $\eta$ is more than 2, the toner in the developer material was not stably charged, because the toner particles were so densely adhered on the carrier that they were apt to be thrown off from the carrier. Therefore, the ratio $\eta$ according to the present invention is in the range of from 0.5 to 2.0 and, preferably, in the range of from 0.6 to 1.2.

We claim:

1. A process for preparing a developer for electrostatic images comprising the steps of:

(1) immersing carrier beads in an organic solution of a resin coating material comprising a butadiene homopolymer which is 1,2-polybutadiene or cyclized cis-1,4-polybutadiene or a mixture thereof, or a mixture of at least one of said homopolymers and a styrene butadiene copolymer, each said homopolymer having a molecular weight of from 10,000 to 100,000, said mixture containing from 7.5% to 100%, based on the wieght of said mixture, of butadiene in polymerized form and from 0.1 to 10 parts by weight of an organic peroxide based on 100 parts by weight of said resin coating material, and, then evaporating the organic solvent of said solution, drying said immersed beads, and curing said resin coating material by a rotary drying method, comprising steps wherein said immersed beads are put in a vessel and heated while the vessel rotates so as to avoid the aggregation of the coated carrier particles with each other, to form a resin coating on said carrier beads;

(2) blending toner materials at a temperature sufficient to form a toner mass, said toner materials comprising:

(a) from 85% to 95% of a binder resin, based on the weight of said toner materials, comprising, based on the weight of said binder resin, from 50% to 100% by weight of an epoxy resin of a molecular weight of from 900 to 8,000 and up to 50% of a styrene alkylmethacrylate copolymer, said alkyl group having from 1 to 4 carbon atoms, and being of a molecular weight of from 10,000 to 100,000, (b) a colorant comprising, based on the weight of said toner materials, up to 10% of fine carbon and from about 0.5% to 8% of nigrosine dye, and (c) up to 8% of a charge controlling agent, based on the weight of said toner materials, wherein said charge controlling agency comprises a control material which is quaternary ammonium alkylsulfonate, said alkyl group having from 4 to 20 carbon atoms, di-(poly-hydroxy ethoxy ethyl) octadecyl amine, or a polyamine; and (d) up to 1% of montan wax based on the weight of said toner materials;

(3) pulverizing said blended toner mass to form toner particles and mixing the obtained toner particles with said coated carrier, the ratio of the total surface area of said carrier to the total projection area of said toner particles being in the range of from 1:0.5 to 1:2.0.

2. A process for preparing a coated carrier for an electrostatic developer comprising the steps of:

(1) immersing core beads in an organic solution of a resin coating material comprising a butadiene homopolymer which is 1,2-polybutadiene or cyclized cis-1,4-polybutadiene or a mixture thereof, or a mixture of at least one of said homopolymers and a styrene butadiene copolymer, each said homopolymer having a molecular weight of from 10,000 to 100,000, said mixture containing from 7.5% to 100% by weight, based on the weight of said mixture, of butadiene in polymerized form and from 0.1 to 10 parts by weight of an organic peroxide based on 100 parts of weight of said resin coating material; and (2) evaporating the organic solvent of said solution; drying said immersed beads, and curing said resin material by rotary drying method, comprising steps wherein said immersed beads are put in a vessel and heated while the vessel rotates so as to avoid aggregation of the coated carrier particles with each other.

3. The process of claim 1 or 2, said resin coating material comprising said cyclized cis-1,4-polybutadiene forming a three-dimensional structure having a lower cross-linking density than that formed by said 1,2-polybutadiene.

4. The process of claim 1 or 2, comprising adjusting the relative proportions of said 1,2-polybutadiene and said cyclized cis-1,4-polybutadiene to obtain a predetermined value for the hardness of said resin coating material coated on said carrier.

5. The process of claim 1 or 2, wherein said resin coating material comprises more than 90% of butadiene in polymerized form based on the weight of said resin coating material.

6. The process of claim 1 or 2, wherein said resin coating material comprises less than 10% of a fluorine-containing polymer based on the weight of said resin coating material.

7. The process of claim 6, wherein said organic peroxide is dicumyl peroxide.

8. The process of claim 1 or 2, wherein the thickness of the resin coating is in the range of from 0.3 to 20 μm.

9. The process of claim 1 or 2, wherein the thickness of the resin coating is in the range of from 0.7 to 2.0 μm.

10. The process of claim 1 or 2, said carrier beads comprising spherical iron shot.

11. The process of claim 1 or 2, said carrier beads comprising spherical iron shot having recesses on their surface.

12. The process of claim 1 or 2, said carrier beads comprising thin plate-like iron flakes.

13. The process of claim 1 or 2, said carrier beads comprising thick iron flakes.

14. The process of claim 1 or 2, said carrier beads comprising glass beads.

15. The process of claim 1 or 2, said carrier beads having a diameter in the range of from 30 to 500 μm.

16. The process of claim 1 or 2, said carrier beads having a diameter in the range of from 100 to 250 μm.

17. The process of claim 1, said epoxy resin of the toner comprising at least 5% to 20% of an epoxy resin having an epoxy equivalent higher than 1000.

18. The process of claim 1, wherein said epoxy resin of the toner comprises up to 4% of monomeric bisphenol A glycidyl ether based on the weight of said epoxy resin.

19. The process of claim 1, wherein said toner comprises from 3% to 6% of said carbon based on the weight of said toner material.

20. The process of claim 1, wherein said toner comprises from 1% to 3% of said nigrosine dye based on the weight of said toner material.

21. The process of claim 1, wherein said toner comprises from 2% to 4% by weight of said charge controlling agent, based on the weight of said toner material.

22. The process of claim 1, said developer being flash fusible, and said toner comprising:

said binder resin comprising more than 95% by weight, based on said binder resin, of a bis-phenol A epichlorohydrin type of said epoxy resin having an epoxy equivalent of from 450 to 5,500, a molecular weight of from 900 to 8,000, and a melting point of from 60° C. to 160° C.; and said colorant comprising, based on the weight of said toner, at least 0.6% of said carbon and from about 0.6% by weight of said carbon and from about 0.5% to 5% by weight of said nigrosine dye.

23. A process for preparing a developer as claimed in claim 1, 17, 18, 20 or 22, wherein said charge control agent is said polyamine and said polyamine is polyolefin polyamine of a molecular weight of from 1,000 to 100,000 expressed by the formula:

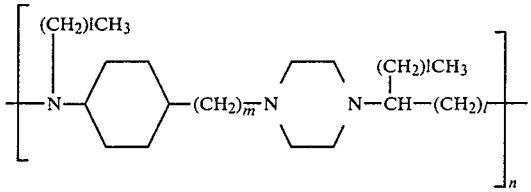

where l=0 or 1 and m=1 or 2.

24. The process of claim 1, said toner particles having a size in the range of from 5 to 30 μm.

25. The process of claim 1, 17, 18, or 22, wherein the ratio of the total surface area of said carrier to the total projection area of said toner particles is in the range of from 1:0.6 to 1:1.2.

26. The process of claim 1 or 2, said organic solution comprising said mixture of at least one of said homopolymers and said styrene butadiene copolymer, wherein the proportions of each said homopolyer to said butadiene copolymer is selected for maintaining the solubility of said mixture in the solvent of said organic solution with increasing amounts of butadiene in polymerized form in said mixture.

27. The process of claim 1 or 22, said organic solution being a solution of said mixture, and said toner comprising non-zero effective amounts of said styrene alkyl methacrylate copolymer, said fine carbon and said charge control agent.

28. The process of claim 22, wherein said epoxy resin of the toner comprises up to 4% of monomeric bisphenol A glycidyl ether based on the weight of said epoxy resin.

29. The process of claim 22, wherein the toner comprises from 0% to 1% of montan wax based on the weight of said toner materials.

30. The process of claim 22, wherein said toner comprises from 3% to 6% of said carbon based on the weight of said toner material.

31. The process of claim 22, wherein said toner comprises from 1% to 3% of said nigrosine dye based on the weight of said toner material.

32. The process of claim 22, wherein said toner comprises 2% to 4% of weight of said charge controlling agent, based on the weight of said toner material.

33. The process of claim 1 or 2, wherein said resin coating material includes less than 10% of a flourine containing polymer.

34. The process of claim 22, wherein an amount of said epoxy resin in the range from 5 to 20% has an epoxy equivalent of higher than 900.

35. The process of claim 1, 2 or 22, wherein said range of said organic peroxide is from 0.5 to 5 parts by weight.

36. The process of claim 35, said peroxide being dicumyl peroxide.

37. The process of claim 1, said toner materials comprising a non-zero effective amount of at least one of said styrene alkyl methacrylate copolymer, said carbon and said charge control agent.

38. The process of claim 37, comprising said effective amount of at least two of said styrene alkyl methacrylate copolymer, said carbon and said charge control agent.

39. The process of claim 22, said toner materials comprising a non-zero effective amount of at least one of said styrene alkyl methacrylate copolymer and said charge control agent.

40. The process of claim 1 or 22, wherein said epoxy resin is selected to have an epoxy equivalent in the range from 450 to 4,500.

41. The process of claim 40, wherein said epoxy resin is selected to have a melting point between 60° and 160° C.

* * * * *

UNITED STATES PATENT AND TRADEMARK OFFICE

CERTIFICATE OF CORRECTION

PATENT NO. : 4,522,909

DATED : June 11, 1985

INVENTOR(S) : TOSHIAKI NARUSAWA et al

It is certified that error appears in the above-identified patent and that said Letters Patent is hereby corrected as shown below:

Column 1, line 46, "mater" should be --matter--.

Column 4, line 57, after "another" insert --type--.

Column 6, line 45, "$(CH_2)$l" should be --$(CH_2)_l$--;
line 46, "$(CH_2)$l" should be --$(CH_2)_l$--;
line 48, "$(CH_2)$l" should be --$(CH_2)_l$--;
line 53, the first occurrence of "l" should be --$l$--.

Column 7, line 14, delete "more".

Column 11, line 19, delete "thick".

Column 12, line 4, "6" should be --7--;
line 5, "7" should be --8--;
line 68, delete ")".

Column 13, line 6, "perticles" should be --particles--.

Column 15, line 14, "solution;" should be --solution,--.

Signed and Sealed this

*Twelfth* Day of *November 1985*

[SEAL]

*Attest:*

DONALD J. QUIGG

*Attesting Officer*

*Commissioner of Patents and Trademarks*